US005158217A

United States Patent [19]

Huminsky et al.

[11] Patent Number: 5,158,217

[45] Date of Patent: Oct. 27, 1992

[54] TWIST LOCK JUNCTION BETWEEN REFRACTORY TUBULAR SHAPES

[76] Inventors: Donald D. Huminsky, 9100 Ringelsen Rd., Allison Park, Pa. 15101; James P. Cummings, Jr., Rte. 2, Box 241-A, Frostburg, Md. 21532

[21] Appl. No.: 514,375

[22] Filed: Apr. 26, 1990

[51] Int. Cl.[5] ..... B22D 37/00

[52] U.S. Cl. ..... 222/591; 222/594; 164/138

[58] Field of Search ..... 249/109; 164/337, 437, 164/138; 222/591, 594, 606, 607, 590; 138/155

[56] References Cited

U.S. PATENT DOCUMENTS

| | | | |
|---|---|---|---|
| 212,072 | 2/1879 | Walker | 138/155 |
| 219,120 | 9/1879 | Schreier | 138/155 |
| 1,333,305 | 3/1920 | Gathmann | 249/109 |
| 2,475,805 | 7/1949 | Saylor | 249/109 |
| 3,189,960 | 6/1965 | Bright | 164/337 |
| 3,865,177 | 2/1975 | Ahacic et al. | 164/337 |
| 4,506,813 | 3/1985 | Dughan et al. | 138/155 |
| 4,512,544 | 4/1985 | Eckenrode et al. | 249/109 |

FOREIGN PATENT DOCUMENTS 0439526 12/1935 United Kingdom ..... 249/109

*Primary Examiner*—Scott Kastler

[57] ABSTRACT

The disadvantages of the prior art are substantially overcome by a twist lock junction and method having the mating joints of refractory tubular shapes formed in a polygonal configuration. Each junction includes a polygonal female recess and a complementary interfitting polygonal male projection. The female recess is dimensionally larger than that of the adjoining male projection. When either the female or male joint is rotated clockwise or counterclockwise relative to the other, a multi-point wedging or "twist lock" effect occurs. This wedging condition offers a tighter fit than the conventional gravity or circular fit. In addition, this "twist lock" effect squeezes the mortar applied to the joints and forces a thin seal near the sites of the point loading. This decreases the chance of metal leakage or fracture of the mortar seal due to mechanical abuse.

24 Claims, 8 Drawing Sheets

TWIST LOCK JUNCTION BETWEEN REFRACTORY TUBULAR SHAPES

BACKGROUND OF THE INVENTION

This invention relates to refractory shapes and, more particularly, it concerns an improved design to join and align refractory tubular shapes such as used in the bottom pouring of steel.

As generally used in the steel making arts and as employed in this specification, the term, "bottom pouring" connotes the conveying of molten steel into a mold from or through its bottom. Typically, bottom pouring is done to improve surface quality of certain grades of steel, although bottom pouring is also practiced in those steel making facilities where continuous casting is not economical. Usually, bottom pouring is done to simultaneously fill with molten metal a gang of molds which are connected in series or parallel to a runner system composed of tubular refractory shapes.

The refractory tubular shapes used in a conventional bottom pouring process include a variety of configurations such as, tee outlets, ell outlets, and risers which are arranged in selected sequences to form continuous conduits. For example, the shapes are arranged in simple runner configurations or in complex configurations in which the runners are connected to a central distributor (spider) which directs the flow of metal to ingot molds placed in various localities. Such tubular refractory shapes are typically made from fireclay or high alumina compositions. The tubular shapes are pieced together in sections to form the "plumbing" or "pipe" required to transport molten melt from a ladle to a mold. The tubular shapes must be joined tightly to prevent leakage while the molten steel is being transported through the refractory "pipe".

Current bottom pouring techniques employ a simple male-to-female fit to piece the refractory tubular shapes together. Usually, a circular male projection at the end of one section fits into a corresponding circular female recess at the end of another section thereby forming a continuous conduit for the transport of the molten steel. Because the tubular refractory shapes are usually made from a relatively high proportion of crude clay, considerable shrinkage occurs during manufacture of the refractory section. Therefore, it is very difficult to maintain tight tolerances between the male projection and the corresponding female recess which join adjacent shapes. Typically, gaps of ⅛ inch are common.

To prevent metal leakage through the gap between the interfitting projection and recess of abutting refractory shapes, a refractory mortar is used to fill the gap. The gap allows for misalignment of the central bores of the shapes when the tubular sections are pieced together. If the bores are misaligned, the molten metal impacts a portion of an end face of at least one of the joined sections, and tends to push the refractory sections apart. The mortar-filled gap is also a source of weakness which is vulnerable to breakage due to mechanical stress and infiltration of molten metal. Further, a poor fit between refractory sections used to convey molten metal has lead in many instances to poor mold fill due to metal leakage before the mold. Moreover, a poor fit between a riser and an outlet can cause the riser to dislodge off of the outlet and float up in the molten steel within the mold. When this occurs, the ingot is usually scrapped.

In light of the foregoing, there is a need for an improved junction between tubular refractory shapes of the type referred to.

SUMMARY OF THE INVENTION

In accordance with the present invention, the disadvantages of the prior art are substantially overcome by a twist lock junction and method having the mating joints of refractory tubular shapes formed in a polygonal configuration. Each junction includes a polygonal female recess and a complimentary interfitting polygonal male projection. The female recess is dimensionally larger than that of the adjoining male projection. When either the female or male joint is rotated clockwise or counterclockwise relative to the other, a multi-point wedging or "twist lock" effect occurs. This wedging condition offers a tighter fit than the conventional gravity or circular fit. In addition, this "twist lock" effect squeezes the mortar applied to the joints and forces a thin seal near the sites of the point loading. This decreases the chance of metal leakage or fracture of the mortar seal due to mechanical abuse.

In accordance with a preferred embodiment, the mating joints of refractory tubular shapes are formed in a generally hexagonal configuration having rounded corners. In accordance with this preferred embodiment, the female component includes a generally hexagonal counterbore and the male component includes a generally hexagonal flange. The hexagonal counterbore is dimensionally larger than the hexagonal flange not only to allow the counterbore to telescopically receive the flange given manufacturing tolerances, but also to provide for the corners of the flange to wedge against the flat sides of the counterbore.

Accordingly, a principal object of the present invention is to provide a junction of two bottom pour refractory components which upon twisting of one component relative to the other a plurality of friction points tend to lock the two components together and coaxially align the bores of the components. Another and more specific object of the invention is the provision of a polygonal joint configuration wherein the facet to facet dimension of the female joint is less than the point to point dimension of the male joint but greater than the facet to facet dimension of the male joint. Other objects and further scope of applicability of the present invention will become apparent from the detailed description to follow taken in conjunction with the accompanying drawings in which like parts are designated by like reference characters.

DETAILED DESCRIPTION OF THE PREFERRED EMBODIMENT

Figure 1:
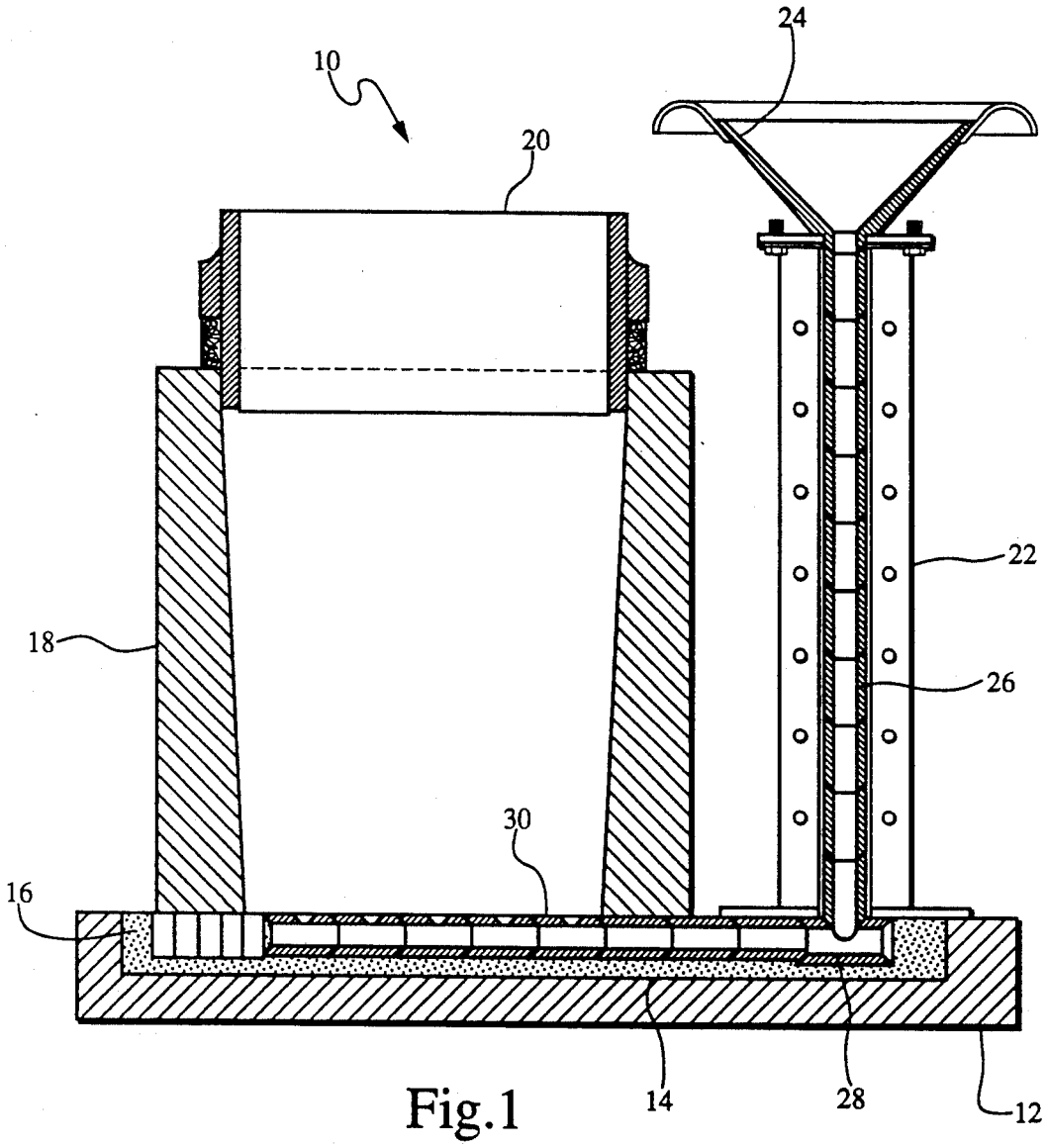
FIG. 1 is a cross section illustration of a typical bottom pouring setup for an open bottom mold.

In FIG. 1 of the drawings, a typical open bottom mold bottom pouring operation is generally designated 10 and shown to include a base 12 which is known in the art as a sprue plate. Within the plate 12, there is provided a recessed area 14 partially filled with a suitable substance such as sand 16. This material forms a convenient bed for the remaining portions of the equipment, provides some general thermal insulation qualities, and permits the expansion and contraction of the refractory tubular shapes used to convey the molten steel into a mold 18. The mold 18 is insulated by a hot top 20 at the upper part of the mold 18. The main purpose of the hot top 20 is to provide controlled solidification of the ingot to prevent piping.

At the right side of FIG. 1, there is shown a vertical fixture known in the art as a fountain 22. The fountain 22 provides for the introduction of molten steel from a ladle into a pouring funnel 24 located on top of the fountain and thence downwardly through the refractory lining which is in the form of tubular shaped runners or tiles 26. The interior of the fountain 22 is connected via a king brick 28 to a horizontal refractory pipe or runner 30 which introduces molten metal into the base of the mold 18.

FIG. 1 outlines a simplistic approach to bottom pouring. The drawing only shows one open bottom mold 18 connected to the runner assembly 30. In reality, numerous molds are filled from the contents of a ladle and numerous runner assemblies are required to fill the various molds. Often the fountain is connected to a distributor or spider which conveys the molten metal in various directions to awaiting molds. FIG. 1 shows a simple system in which the runner tile are in the form of simple open-ended shapes. The tubular refractory shapes needed to convey molten steel in a bottom pouring application often take the form of more complex shapes as shown in FIGS. 3-10.

Figure 2:
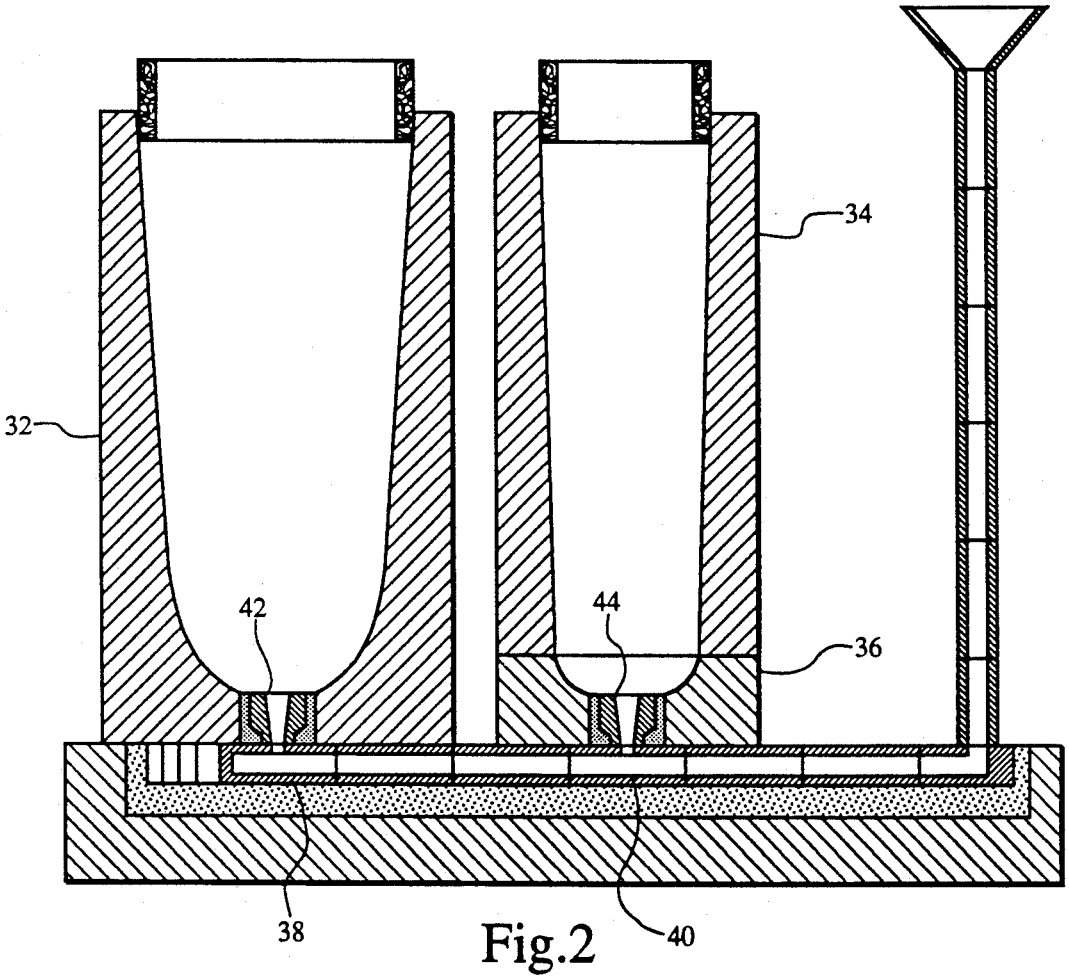
FIG. 2 is a cross section representation of a typical bottom pouring setup for plug bottom molds and open bottom molds on intermediate stools.
Figure 4:
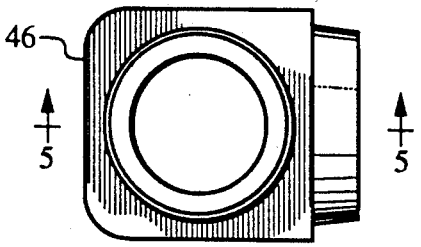
FIGS. 3 and 4 are top and end views, respectively, of a conventional ell shape used in bottom pouring.
Figure 5:
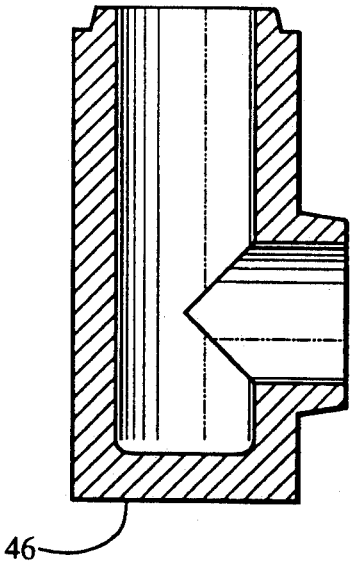
FIG. 5 is a cross-sectional side view taken along line 5—5 in FIG. 4.
Figure 3:
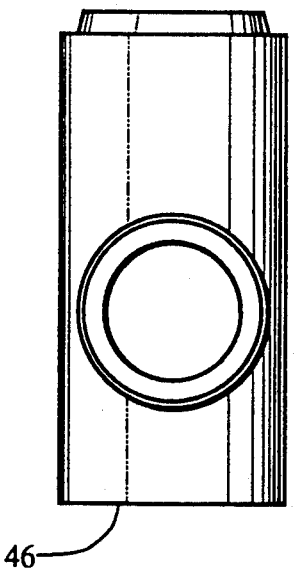
Figure 7:
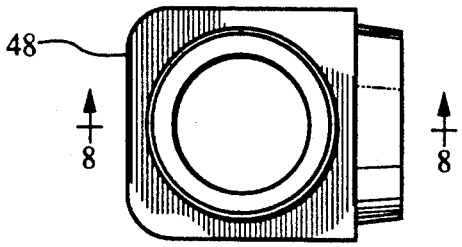
FIGS. 6 and 7 are top and end views, respectively, of a conventional tee shape used in bottom pouring.
Figure 8:
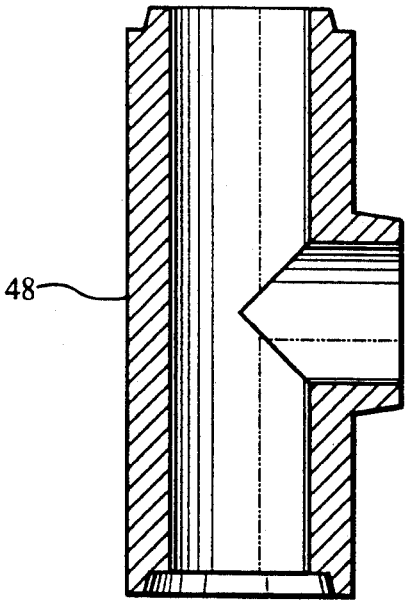
FIG. 8 is a cross-sectional side view taken along line 8—8 in FIG. 7.
Figure 6:
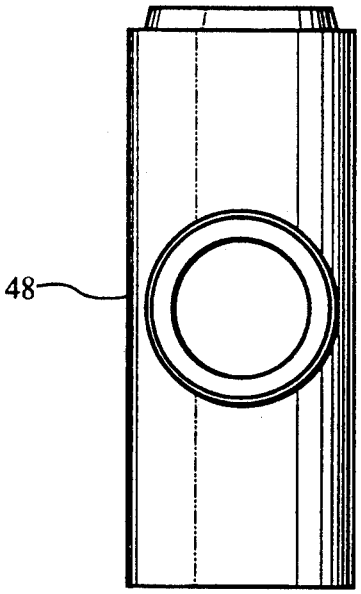
Figure 9:
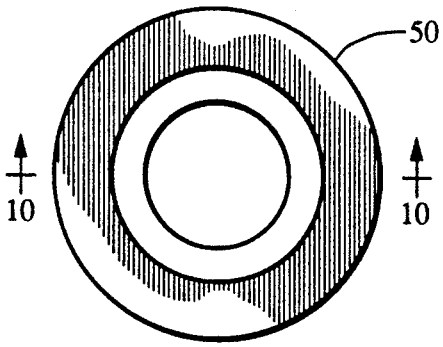
FIG. 9 is a top view of a conventional upriser shape used in bottom pouring.
Figure 10:
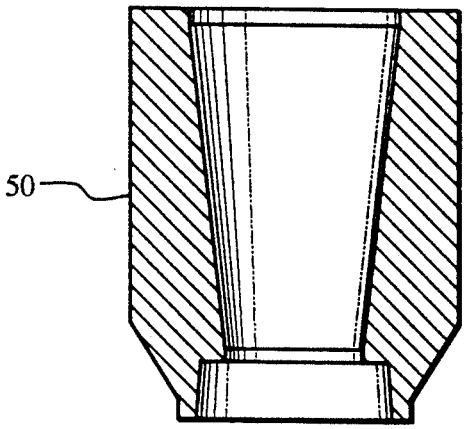
FIG. 10 is a cross-sectional side view taken along line 10—10 in FIG. 9.

FIG. 2 outlines a typical, simplistic example of a plug bottom mold 32 and an opened bottom mold 34 on an intermediate stool 36. These are typical situations that require the use of outlets 38 and 40 with risers 42 and 44. The outlet 38 corresponds to the conventional ell shape 46 shown in FIGS. 3-5. The outlet 40 corresponds to the conventional tee shape 48 shown in FIGS. 6-8. The risers 42 and 44 each correspond to the conventional riser 50 shown in FIGS. 9 and 10. All of these special shapes as well as the typical runner tile have a common feature—all are comprised of discrete segments connected together by abutting adjoining sections.

Figure 11:
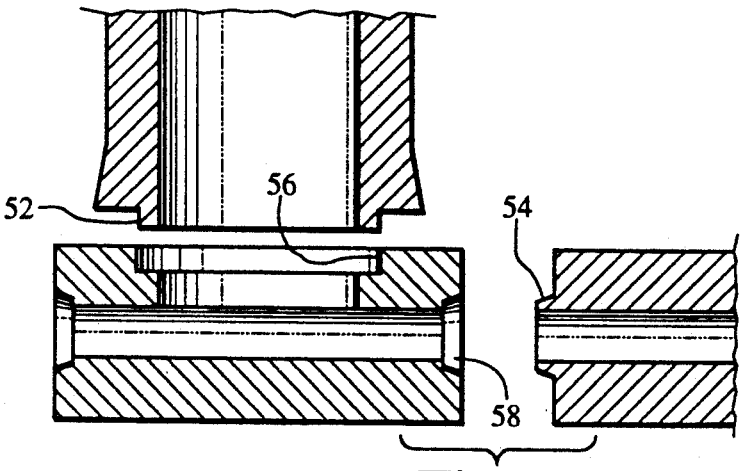
FIG. 11 is an exploded, cross-sectional illustration of the mating surfaces of a conventional runner tile arrangement.
Figure 13:
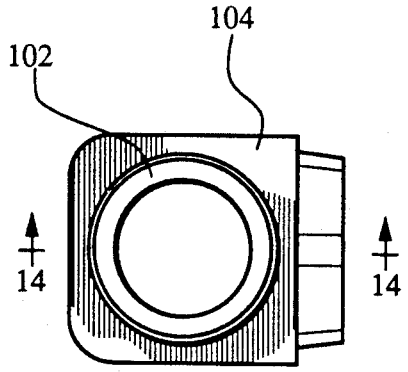
FIGS. 12 and 13 are top and end views, respectively, representing an exemplary ell shape with a hexagonal male projection in accordance with the present invention.
Figure 15:
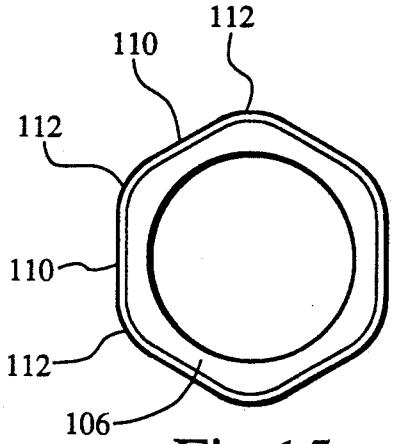
FIG. 15 is an enlarged top view of the hexagonal male projection taken along line 15—15 in FIG. 14.
Figure 14:
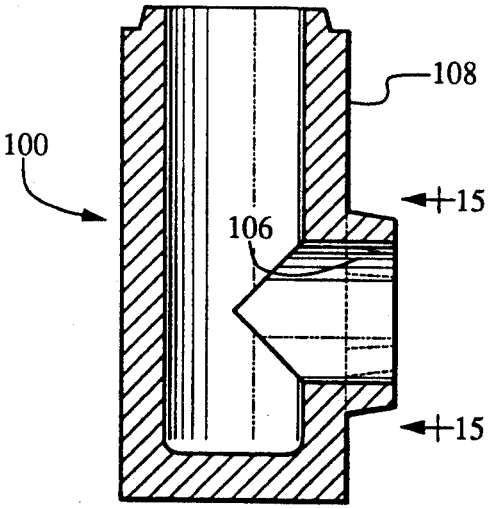
FIG. 14 is a cross-sectional side view taken along line 14—14 in FIG. 13.
Figure 12:
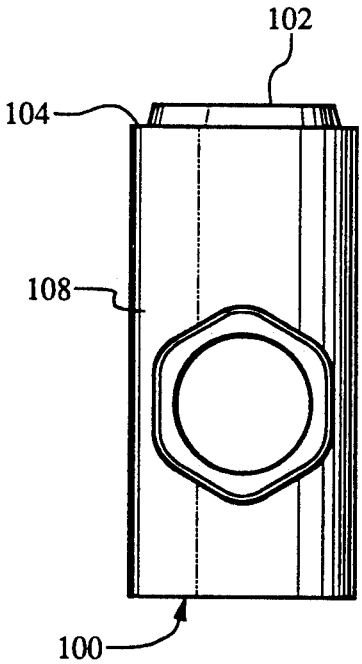
Figure 17:
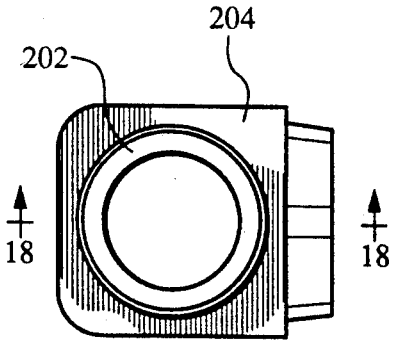
FIGS. 16 and 17 are top and end views, respectively, illustrating an exemplary tee shape having a hexagonal male projection in accordance with the present invention.
Figure 19:
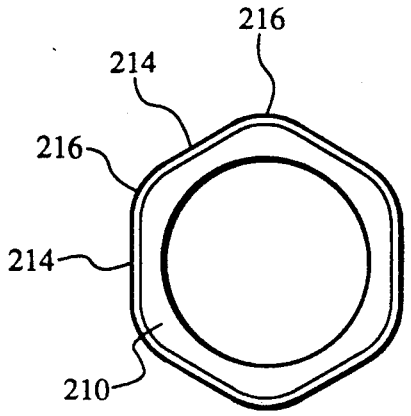
FIG. 19 is an enlarged top view of the hexagonal male projection taken along line 19—19 in FIG. 18.
Figure 18:
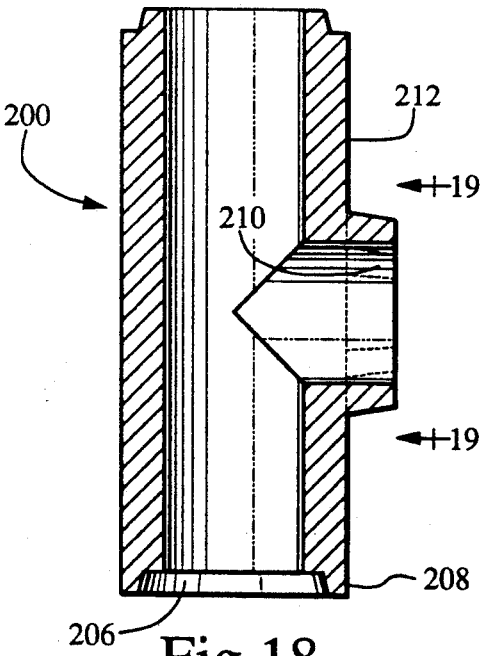
FIG. 18 is a cross-sectional side view taken along line 18—18 in FIG. 17.
Figure 16:
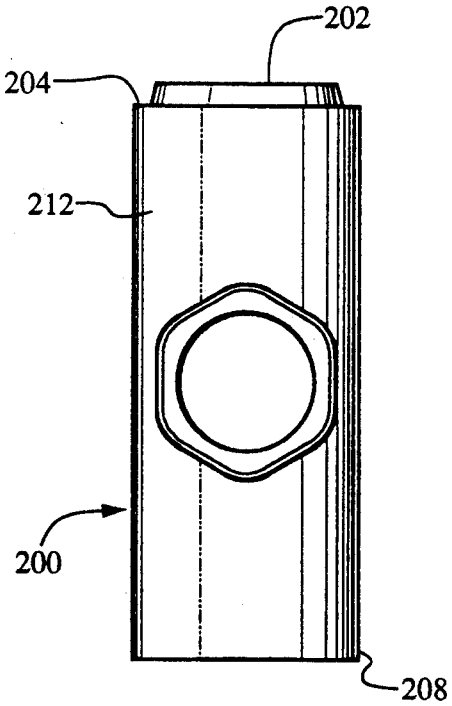

As shown in FIG. 11 of the drawings, all of these conventional tubular refractory shapes abut together by means of a circular male projection 52 and 54 which is received within a larger circular female recess 56 and 58, respectively. As mentioned above, it is this manner of fit between the circular male projection and female recess of adjoining shapes which can lead to metal leakage from the runner system.

In accordance with the present invention, the poor fit between adjoining members of conventional runner systems is improved by forming the male projection and the female recess in the form of a polygon rather than a circle. Generally, in accordance with the present invention, a polygonal male projection is inserted in a larger-sized polygonal female recess and then one of the projection or recess is rotated relative to the other so that the points of the smaller male polygonal projection form a multi-point contact with the flats of the female polygonal recess. Runner tile members made with hexagonal male projections in accordance with the present invention are shown in FIGS. 12-15 and 16-19, respectively. The multi-point wedging effect made by contacting the adjoining polygonal surfaces of the present invention provides a stronger mechanical fit than that of conventional circular joints.

With reference to FIGS. 12-15 of the drawings, an exemplary embodiment of an ell shape in accordance with the present invention is generally designated 100 and shown to include a circular male projection 102 extending from one end 104 and a substantially hexagonal male projection 106 extending from an upper surface 108. The hexagonal male projection 106 includes a plurality of flats 110 and rounded corners 112.

Similarly, as shown in FIGS. 16-19 of the drawings, an exemplary embodiment of a tee shape in accordance with the present invention is generally designated 200 and shown to include a circular male projection 202 extending from a first end 204, a circular female recess 206 in a second end 208, and a hexagonal male projection 210 extending from an upper surface 212. The hexagonal male projection 210 includes a plurality of flats 214 and curved corners 216.

Figure 20:
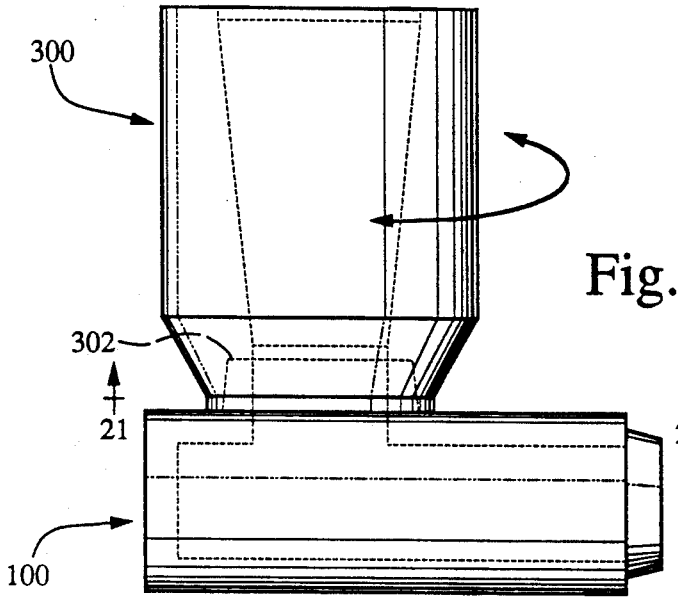
FIG. 20 is a schematic side view illustrating the assembly of an outlet tile to a riser in accordance with the present invention.
Figure 21:
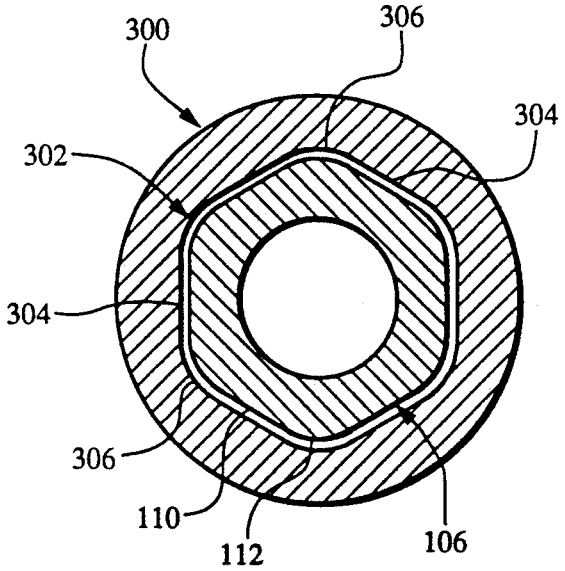
FIG. 21 is a schematic representation of the hexagonal male projection of the outlet tile resting in the hexagonal female recess of the riser taken along line 21—21 in FIG. 20; and, FIG. 22 is a schematic illustration of the relative positions of the male projection and female recess of FIGS. 20 and 21 following rotation of the riser to lock the shapes and align their bores in accordance with the present invention.
Figure 22:
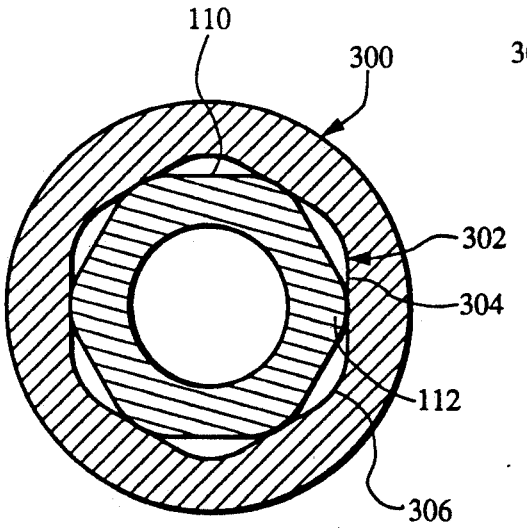

The multi-point wedging effect of the present invention is further clarified by FIGS. 20-22. With particular reference to FIG. 20 of the drawings, the outlet tile 100 is joined with an exemplary riser 300 having a hexagonal female recess 302 adapted to receive the hexagonal male projection 106 of the outlet 100. The female recess 302 includes a plurality of flats 304 and corners 306.

With reference to FIGS. 21 and 22, assembly of the outlet tile 100 to the riser 300 begins by joining the two shapes with the male projection 106 received within the female recess 302 with the corners and flats aligned as shown in FIG. 21. Then, the riser 300 is rotated or twisted relative to the outlet 100 with sufficient force to cause each of the corners 112 of the male projection 106 to wedge against a corresponding flat 304 of the female recess 302. Prior to joining the outlet 100 and riser 300, a mortar may be added between the male projection 106 and the female recess 302. When mortar is used to seal the joint, it is compressed at and near the six corners 112 of the male projection 106. This compression provides for a stronger mortar seal which resists metal leakage and failure due to mechanical abuses.

Thus, it will be appreciated that as a result of the present invention, a highly effective refractory design and method is provided by which the principal object and others are completely fulfilled. It is contemplated and will be apparent to those skilled in the art from the foregoing description and accompanying drawing illustrations that variations and/or modifications of the disclosed embodiment may be made without departure from the invention.

For example, although the preferred embodiments of FIGS. 12–22 show hexagonal male projections and female recesses, it is contemplated that other polygonal or multi-lobed configurations which provide for multiple points of contact and a wedging effect can be used. Further, even though each of the shapes of FIGS. 12–22 has only one hexagonal recess or projection, it is to be understood that the circular flanges or recesses of these shapes may be replaced with polygonal flanges and recesses.

Accordingly, it is expressly intended that the foregoing description and accompanying drawings are illustrative of preferred embodiments only, not limiting, and that the true spirit and scope of the present invention be determined by reference to the appended claims.

What is claimed is:

1. A refractory tubular shape used to convey molten metal comprising a refractory body having at least one cylindrical bore and at least one regular polygonal shaped male projection defining one component of a two component twist lock junction and adapted to fit into a larger sized, adjoining regular polygonal female recess in an adjoining shape having at least one cylindrical bore, the recess defining the other component of the twist lock junction, with said male projection dimensioned so as to provide for limited rotation of one component relative to the other component and multi-point wedging between the corners of said projection and the central area of the flats of said recess upon rotation of one shape relative to the other shape and thereby provide a friction lock therebetween and facilitate the coaxial alignment of the bores of the adjoining shapes.

2. The refractory tubular shape of claim 1, wherein said polygonal shaped projection is hexagonal.

3. The refractory tubular shape of claim 1, wherein said shape is an ell shape.

4. The refractory tubular shape of claim 1, wherein said shape is a tee shape.

5. The refractory shape of claim 1, wherein said shape is an outlet.

6. The refractory shape of claim 2, wherein said shape is an ell shape.

7. The refractory shape of claim 2, wherein said shape is a tee shape.

8. The refractory shape of claim 2, wherein said shape is an outlet.

9. The refractory shape of claim 1, wherein said shape includes a plurality of polygonal shaped male projections.

10. A refractory tubular shape used to convey molten metal comprising a refractory body having at least one cylindrical bore and at least one regular polygonal shaped female recess defining one component of a two component twist lock junction and adapted to receive a smaller sized, adjoining regular polygonal male projection in an adjoining shape, the male projection defining the other component of the twist lock junction and having at least one cylindrical bore, with said recess dimensioned so as to provide for limited rotation of one component relative to the other component and multi-point wedging between the points of said male projection and the central area of the flats of said recess upon rotation of one shape relative to the other shape and thereby provide a friction lock therebetween and facilitate the coaxial alignment of the bores of the adjoining shapes.

11. The refractory tubular shape of claim 10, wherein said polygonal shaped recess is hexagonal.

12. The refractory tubular shape of claim 10, wherein said shape is a riser.

13. The refractory tubular shape of claim 12, wherein said polygonal shaped recess is hexagonal.

14. A twist lock junction between refractory shapes having refractory bodies and cylindrical bores, comprising a regular polygonal male projection on one of said shapes defining one component of a two component twist lock junction and a complimentary regular polygonal female recess on the other of said shapes defining the other component, said female recess having a flat to flat dimension which is smaller than the point to point dimension of said male projection but which is greater than the flat to flat dimension of said male projection to provide for limited rotation of one component relative to the other component and multi-point wedging between the points of said male projection and the central area of the flats of said recess upon rotation of one shape relative to the other shape and thereby provide a friction lock therebetween and facilitate the coaxial alignment of the bores of the adjoining shapes.

15. The twist lock junction of claim 14, wherein said shapes comprise an outlet and a riser.

16. The twist lock junction of claim 14, wherein said male projection and said female recess are substantially hexagonal.

17. The twist lock junction of claim 15, wherein said male projection and said female recess are substantially hexagonal.

18. A method of joining and aligning the bores of refractory tubular shapes comprising the steps of:

forming a first refractory shape with a polygonal male projection, forming a second refractory shape with a complimentary polygonal female recess, joining said shapes so that said projection is received within said recess, and rotating one of said shapes relative to the other so that the corners of said male projection contact the flats of said female recess to provide a friction lock between said shapes and to facilitate alignment of the bores of said shapes.

19. The method of claim 18, further comprising the step of adding a refractory mortar between said male projection and said female recess prior to rotating one of said shapes relative to the other.

20. The method of claim 18, wherein said male projection and said female recess are hexagonal.

21. The refractory tubular shape of claim 1, wherein said polygonal shaped projection has rounded corners.

22. The refractory tubular shape of claim 10, wherein said polygonal shaped recess has rounded corners.

23. The twist lock junction of claim 14, wherein said male projection and said female recess have rounded corners.

24. The method of claim 18, wherein said male projection and said female recess have rounded corners.

* * * * *